US009545532B2

(12) United States Patent
Miller

(10) Patent No.: US 9,545,532 B2
(45) Date of Patent: Jan. 17, 2017

(54) TRAMPOLINE ACCESSORY ATTACHMENT SYSTEM

(75) Inventor: David Jethro Miller, Christchurch (NZ)

(73) Assignee: BOARD & BATTEN INTERNATIONAL INC., Georgetown (KY)

( * ) Notice: Subject to any disclaimer, the term of this patent is extended or adjusted under 35 U.S.C. 154(b) by 0 days.

(21) Appl. No.: 14/233,828

(22) PCT Filed: Jul. 23, 2012

(86) PCT No.: PCT/NZ2012/000128
§ 371 (c)(1),
(2), (4) Date: Dec. 11, 2014

(87) PCT Pub. No.: WO2013/012347
PCT Pub. Date: Jan. 24, 2013

(65) Prior Publication Data

US 2015/0157889 A1 Jun. 11, 2015

Related U.S. Application Data

(60) Provisional application No. 61/510,369, filed on Jul. 21, 2011, provisional application No. 61/579,717, filed on Dec. 23, 2011.

(51) Int. Cl.

| | |
|---|---|
| ***A63B 5/11*** | (2006.01) |
| ***A63B 71/02*** | (2006.01) |
| *A63B 71/00* | (2006.01) |

(52) U.S. Cl.
CPC ..... *A63B 5/11* (2013.01); *A63B 71/022* (2013.01); *A63B 71/023* (2013.01); *A63B 2071/0063* (2013.01); *A63B 2210/50* (2013.01)

(58) Field of Classification Search
USPC ..... 482/1–148
See application file for complete search history.

(56) References Cited

U.S. PATENT DOCUMENTS

| | | | | |
|---|---|---|---|---|
| 4,569,515 | A * | 2/1986 | Gordon | A63B 5/11 273/401 |
| 4,900,011 | A * | 2/1990 | Nolet | A47D 13/063 482/29 |
| 5,010,603 | A * | 4/1991 | Hertzog | E04H 4/0043 4/488 |
| 5,402,988 | A | 4/1995 | Eisele | |
| 5,941,798 | A | 8/1999 | Coan et al. | |
| 6,607,468 | B1 * | 8/2003 | Nichols, Jr. | A63B 5/11 482/27 |
| D614,715 | S * | 4/2010 | Mann | D21/797 |

(Continued)

FOREIGN PATENT DOCUMENTS

| | | |
|---|---|---|
| CN | 201098487 | 8/2008 |
| CN | 201550979 | 8/2010 |

OTHER PUBLICATIONS

Extended European Search Report, EP Appln. No. 12814159.5, Feb. 20, 2015, pp. 1-3.

*Primary Examiner* — Stephen Crow
(74) *Attorney, Agent, or Firm* — Dann, Dorfman, Herrell and Skillman, P.C.

(57) ABSTRACT

A trampoline accessory attachment system comprises an accessory attachment rail enables attachment of an enclosure, pad, or other accessories to a trampoline.

23 Claims, 7 Drawing Sheets

(56) References Cited

U.S. PATENT DOCUMENTS

| | | | | |
|---|---|---|---|---|
| 7,736,274 | B2 * | 6/2010 | Thibodeaux, Sr. | A63B 5/06 482/15 |
| D653,299 | S * | 1/2012 | Samuel | D21/797 |
| 8,328,695 | B2 * | 12/2012 | Ronan | A63B 5/11 135/156 |
| 8,574,132 | B2 * | 11/2013 | VanElverdinghe | A63B 5/11 482/27 |
| 8,764,575 | B1 * | 7/2014 | Gurley | 472/92 |
| 8,790,221 | B2 * | 7/2014 | Schaffer | A63B 5/11 482/23 |
| RE45,182 | E * | 10/2014 | Nelson | A63B 5/11 482/27 |
| 8,920,290 | B2 * | 12/2014 | Stokes | A63B 5/11 482/27 |
| 9,180,328 | B2 * | 11/2015 | Schaffer | A63B 5/11 |
| 2005/0218392 | A1 | 10/2005 | Petrozziello | |
| 2008/0269021 | A1 | 10/2008 | Publicover | |

* cited by examiner

TRAMPOLINE ACCESSORY ATTACHMENT SYSTEM

CROSS-REFERENCES TO RELATED APPLICATIONS

This application claims the benefit of U.S. Provisional Application No. 61/510,369, filed Jul, 21, 2011 and U.S. Provisional Application No. 61/579,717, filed Dec. 23, 2011, the entireties of which are incorporated herein by reference.

FIELD OF THE INVENTION

The invention relates to a system or mechanism for attaching and detaching auxiliary accessory items to a trampoline.

The invention also relates to a trampoline fitted with a system or mechanism for attaching and detaching auxiliary accessory items to a trampoline.

BACKGROUND OF THE INVENTION

A trampoline is a gymnastic apparatus which in its most basic form generally comprises a rebounding mat fixed to a support frame so that the mat is supported above the ground. A user jumps or otherwise bounces on the rebounding mat for entertainment and exercise. The design of conventional trampolines as are known in the art incorporates a peripheral exterior metal frame with an interposed mat tensioned within the horizontal plane of the frame by conventional extension springs spaced about the edge of the mat and extending outwards from the mat to the frame and attached to the frame. The springs are generally in the same plane as the frame and the rebounding surface of the mat. An example of this type of trampoline design is shown in FIG. 1*b*.

U.S. Pat. No. 6,199,174 discloses a form of soft-edged trampoline in which the mat of the trampoline is supported by a plurality of resiliently flexible rods received in a frame of the trampoline at the lower ends of the rods, the upper end of the rods coupled to the periphery of the bouncing or rebounding mat of the trampoline, this arrangement avoiding the need for a solid frame about the exterior of the bouncing mat, and exposed springs between the frame and periphery of the mat. The rods are angled or spiralled around the frame, extending outwards and upwards from the frame. An example of this type of arrangement is shown in FIG. 1*a*.

Trampolines can be equipped with auxiliary accessories. For example, a ladder or slide can be fitted to the trampoline, extending from the rebounding mat to the floor. Weather-resistant covers are also known, as are tents, basketball stands/hoops, shoe pockets and game mats (e.g. hopscotch or similar). One very common accessory fitted to trampolines is a safety enclosure, which extends upwards from the mat to surround or enclose the rebounding mat to prevent a user from falling off the trampoline onto the floor and injuring themselves. Usually, the safety enclosure is attached to the trampoline around the edge of, and extending upwards from, the rebounding mat, with the upper part open, the safety enclosure sized so that the upper edge that forms the perimeter of the open upper end or part is above the point which an average user could easily bounce over or otherwise fall over. Typically, the safety enclosure is formed from mesh or formed from netting with small apertures, so that users and spectators can see through the enclosure and view and be viewed.

The trampoline portion or 'trampoline' of the trampoline system shown in FIG. 1*a* has a frame, a rebounding mat, and a safety enclosure, the safety enclosure held in position by a number of enclosure support members or poles. The frame and rebounding mat are mutually adapted so that the flexible rebounding mat is held above the frame and away from the ground in tension and aligned in a substantially horizontal plane above the frame. The enclosure support members or poles support the safety enclosure so that the enclosure surrounds, and extends upwards from, the rebounding mat to form an enclosed jumping area. The lower edge of the enclosure is connected to and around the edge of the rebounding mat.

A similar enclosure system is shown in FIG. 1*b*. The poles and safety enclosure surround and extend upwards from the rebounding mat. However, the rebounding mat and frame arrangement of the trampoline shown in FIG. 1*b* is similar to that of the conventional trampoline discussed above, incorporating a peripheral exterior metal frame with an interposed mat tensioned within the horizontal plane of the frame by conventional extension springs spaced about the edge of the mat and extending outwards from the mat to the frame and attached to the frame, with the springs generally in the same plane as the frame and the rebounding surface of the mat. The lower edge of the enclosure is connected to and around the edge of the rebounding mat.

U.S. Pat. No. 6,053,845 describes an enclosure for a trampoline consisting of a net fence or barrier which surrounds the trampoline and is supported by upright poles spaced around the periphery of the trampoline and fixed to the trampoline frame.

U.S. Pat. No. 7,854,687 describes an enclosure system for a trampoline in which a barrier of a flexible material surrounds the mat above the mat with a lower peripheral part of the barrier coupled directly or indirectly to the mat. A plurality of resiliently flexible generally upright enclosure support members are connected to the frame of the trampoline outside of the barrier at or towards their lower ends. An upper peripheral part of the barrier is connected to the support members at their upper ends so as to support the barrier above the mat. The support members are free to resiliently deform away from the mat when impacted by a user against the barrier or an enclosure support member. The lower edge or periphery of the enclosure is positioned against the edge of the mat, and held in position by the tension in the mat support or rebounding rods. The lower edge is not physically and directly connected to the mat.

Associating the lower edge of the enclosure around the edge of the rebounding mat is advantageous, as a close association ensures there is no gap between the enclosure and the rebounding mat through which a limb or similar might pass, increasing the risk of injury to a user. However, in trampolines such as are known in the art, the enclosure is usually assembled onto the trampoline at the same time as the trampoline is assembled. This can make assembling or disassembling the enclosure from or to the trampoline difficult. It can also add to the length of time and the difficulty of assembling a trampoline with enclosure, and due to the difficulty, can lead to trampolines being assembled without the enclosure, potentially leading to an increased likelihood of accidents. It can also be inconvenient to have an integral or semi-integral enclosure net if a user wishes to add or remove auxiliary accessories such as a ladder or a slide, especially if a user wishes to use these accessories in conjunction with the enclosure.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY OF THE INVENTION

It is an object of the invention to provide an improved or at least an alternative connection mechanism by which items such as a safety enclosure can be connected to the periphery of the jumping mat of the trampoline.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

In a first aspect the invention may broadly be said to consist in a trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, an accessory attachment rail having a base connected to the trampoline, and at least one side wall portion, the at least one side wall or walls extending from and angled to the base to define and surround a hollow central area between the wall and the base, and to further define a slot that passes from inside the hollow central area to outside the rail.

Preferably the accessory attachment rail is connected to the rebounding mat, at or close to the edge of the rebounding mat.

Preferably the accessory attachment rail extends substantially around the entire perimeter of the rebounding mat.

Preferably the at least one side wall portion has at least one gap and preferably a plurality of gaps.

Alternatively the at least one side wall portion is continuous.

Preferably two side wall portions extend from the base to form an arch shape having a slot.

Preferably the trampoline system further has at least one fastener which passes through the base of the accessory attachment rail to connect the accessory attachment rail to the mat.

Preferably the trampoline system further has an accessory, the accessory having a connector having a main body portion sized and shaped to within the hollow central area, and an extension portion that extends from the main body portion through the slot to the accessory.

Preferably the accessory is fitted to the trampoline of the trampoline system by sliding the main body portion into the hollow central area from one open end of the rail.

Preferably the accessory is a foam pad, arranged to fit to and over the edge of the trampoline mat to cover the edge of the mat.

Alternatively the accessory is a safety enclosure, the wall of the enclosure fitted with a connector on or close to the lower edge of the wall.

Preferably the slot is open.

In a second aspect the invention may broadly be said to consist in an accessory attachment rail for a trampoline system, comprising:

a base, at least one side wall, extending from and angled to the base to define and surround a hollow central area between the wall and the base, and to further define an open slot that passes from inside the hollow central area to outside the rail, the base having a flat outer surface that rests against part of the trampoline system, the at least one side wall portion having at least one gap and preferably a plurality of gaps.

Preferably two side wall portions extend from the base to form an arch shape having a slot.

Preferably the slot is open.

In a third aspect the invention may broadly be said to consist in an accessory attachment rail for a trampoline system, comprising:

a base, at least one side wall, extending from and angled to the base to define and surround a hollow central area between the wall and the base, and to further define a slot that passes from inside the hollow central area to outside the rail, the base having a flat outer surface that rests against part of the trampoline system, the at least one side wall portion continuous.

Preferably two side wall portions extend from the base to form an arch shape having a slot.

Preferably the trampoline system further has at least one fastener, and the base has at least one corresponding aperture, a portion of the fastener passing through the corresponding aperture to connect the accessory attachment rail to the mat.

Preferably the slot is open.

In a fourth aspect the invention may broadly be said to consist in a safety enclosure for a trampoline system as outlined in any one of the first seven statements above, the safety enclosure comprising:

a wall or walls corresponding to each side of the mat and extending upwards from the edges of the mat substantially vertically, the wall or walls each having a connector attached to or forming part of the lower edge of the wall, the connector located in the hollow central area to connect the base or lower edge of the side wall to the trampoline, the walls supported by wall members or similar connected between an upper part or portion of the wall and the remainder of the trampoline system.

In a fifth aspect the invention may broadly be said to consist in an edge protector for a trampoline system as outlined in any one of the first seven statements above, the edge protector comprising:

an edge protector pad shaped and sized to fit to and over the edge of the trampoline to cover the edge of the mat, a lower surface of the pad having a connector attached to or forming part of the lower surface, the connector located in the hollow central area to connect the base or lower edge of the side wall to the trampoline, the walls supported by wall members or similar connected between an upper part or portion of the wall and the remainder of the trampoline system.

In a sixth aspect the invention may broadly be said to consist in a trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, an accessory attachment rail having a base portion, and a pair of side walls which extend from and which are angled to the base to define and surround a hollow central area between the wall and the base, and to further define a slot that passes from inside the hollow central area to outside the rail, the base portion having a groove which runs substantially the full length of the attachment rail and parallel to the hollow central area, the groove having an outwards-facing opening.

Preferably the groove forms a pair of side walls in the base portion, each of the side walls having at least one trench formed therein and aligned running substantially the length of the side wall.

Preferably the trenches are located at substantially the same position or height on each of the side walls.

Preferably the trenches are formed so that that portion of the side wall between the trench and the groove can be sewn through.

Preferably the trampoline system also has a mat connector, sized and shaped to fit between the side walls which form the slot, a portion of the connector extending through the slot to attach to the trampoline.

Preferably the mat connector is connected to the trampoline mat.

Alternatively the mat connector is connected to the frame.

Preferably the side walls are continuous.

Alternatively the side walls are discontinuous.

Preferably a lower edge of a trampoline accessory is located and fastened into the groove.

Preferably a portion of or attachment to the trampoline mat is located and fastened into the groove.

In a seventh aspect the invention may broadly be said to consist in a trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, a removable accessory attachment rail having;

a base, a first pair of side walls extending from the base in a first direction and angled to the base and to one another to define and surround a first hollow central area between the first walls and the base, and to further define a first slot that passes from inside the hollow central area to outside the rail, a second pair of side walls extending from the base in a second direction and angled to the base and to one another to define and surround a second hollow central area between the second walls and the base, and to further define a second slot that passes from inside the hollow central area to outside the rail.

Preferably the first pair of side walls and the second pair of side walls extend in substantially opposed directions from the base so that the accessory attachment rail has the overall appearance of a capital 'H', with the ends of each one of the four uprights curved or angled inwards towards the other one of the pair.

Preferably the walls are continuous.

Preferably the first pair of walls, or the second pair of walls, or both are discontinuous, on one or both sides.

In an eighth aspect the invention may broadly be said to consist in an accessory attachment rail for a trampoline system comprising;

a base portion, a pair of side walls which extend from and which are angled to the base to define and surround a hollow central area between the wall and the base, and to further define a slot that passes from inside the hollow central area to outside the rail, the base portion having a groove which runs substantially the full length of the attachment rail and parallel to the hollow central area, the groove having an outwards-facing opening.

Preferably the groove forms a pair of side walls in the base portion, each of the side walls having at least one trench formed therein and aligned running substantially the length of the side wall.

Preferably the trenches are located at substantially the same position or height on each of the side walls.

Preferably the trenches are formed so that that portion of the side wall between the trench and the groove can be sewn through.

Preferably the side walls are continuous.

Alternatively the side walls are discontinuous.

In a ninth aspect the invention may broadly be said to consist in an accessory attachment rail for a trampoline system comprising:

a base, a first pair of side walls extending from the base in a first direction and angled to the base and to one another to define and surround a first hollow central area between the first walls and the base, and to further define a first slot that passes from inside the hollow central area to outside the rail, a second pair of side walls extending from the base in a second direction and angled to the base and to one another to define and surround a second hollow central area between the second walls and the base, and to further define a second slot that passes from inside the hollow central area to outside the rail.

Preferably the first pair of side walls and the second pair of side walls extend in substantially opposed directions from the base so that the accessory attachment rail has the overall appearance of a capital 'H', with the ends of each one of the four uprights curved or angled inwards towards the other one of the pair.

Preferably the walls are continuous.

Preferably the first pair of walls, or the second pair of walls, or both are discontinuous, on one or both sides.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

Further aspects of the invention will become apparent from the following description which is given by way of example only and with reference to the accompany drawings which show an embodiment of the device by way of example, and in which.

DETAILED DESCRIPTION OF PREFERRED EMBODIMENTS

Figure 2:
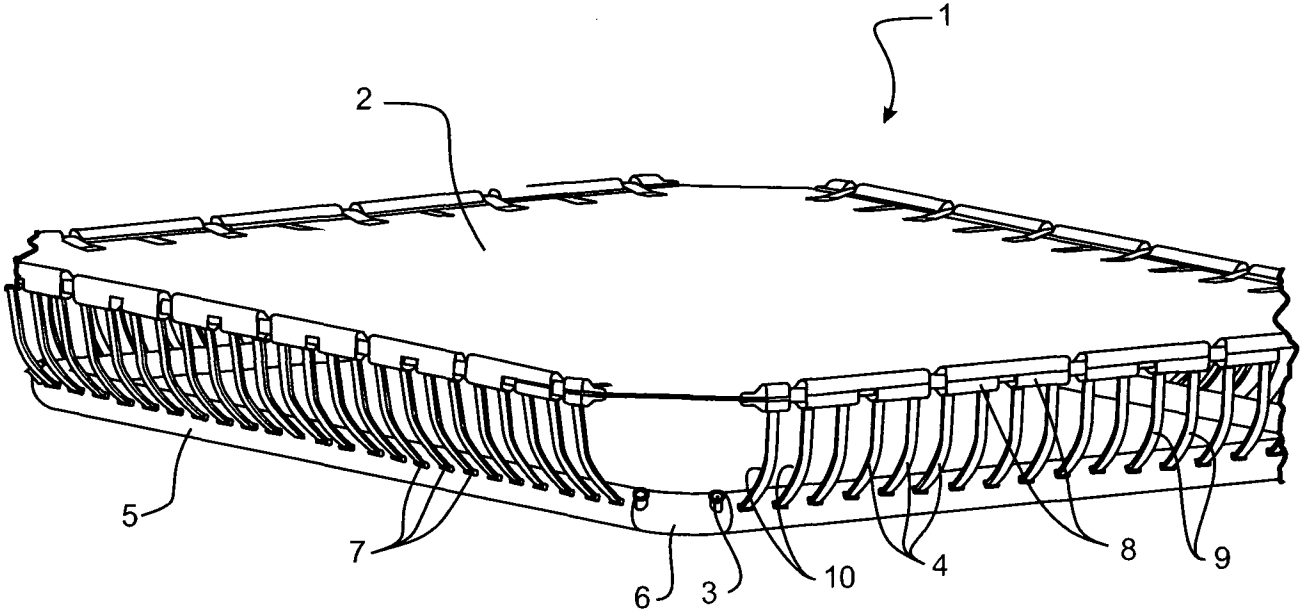
FIG. 2 shows a first preferred form of trampoline having a rectangular outline in plan, the mat of the trampoline supported above a frame of the trampoline by a plurality of resiliently flexible rods which extend outwards from the frame to the mat, substantially perpendicular to the frame, the rods curving outwards and upwards from the frame, the upper ends of the rods connected to the periphery of the mat.

A preferred form of trampoline 1 which is suitable for use with the trampoline accessory attachment arrangement according to the invention is shown in FIG. 2. The trampoline 1 has a flexible rebounding mat 2 and a frame 3, the mat 2 and frame 3 held in position relative to one another by a plurality of support rods 4. The preferred form of trampoline could also be that described in U.S. Provisional 61/497,600, the contents of which are hereby incorporated by reference.

Frame

The frame 3 of the preferred embodiment is generally rectangular in plan view, with a hollow centre. While the preferred form is rectangular, the frame 3 could have any suitable shape, such as square, oval, circular or a multi-sided shape such as hexagonal.

Mat

The preferred form of mat 2 has the same shape as the frame 3, but larger, so that when the mat 2 is placed above the frame 3, each edge of the mat 2 overlaps the frame 3. The mat 2 is formed from a resiliently flexibly material such as woven polypropylene.

Support Rods

The mat 3 is held above the frame 2 in tension by a plurality of support rods 4. Each of the support rods 4 has a lower end 7 which is connected to the frame 3, and an upper end 8 which is connected to the mat 3.

In the most preferred form, the rods 4 form a row along each side of the frame 2 and mat 3. The corners of the trampoline do not have support rods associated with them. In the most preferred form, the corners of the rectangular mat 3 are 'cut off' diagonally between the end one of each row of support rods, to avoid an unsupported or loose portion of material at the corner.

The lower ends of each of the support rods 4 are connected to the frame as follows: a series of holes or apertures are formed in a row along the frame tubes 5, along the outer side of the frame tube 5 and slightly towards the upper part of the frame tube 5. The lower ends 7 of the support rods 4 are inserted into these apertures. The sides of the apertures can be reinforced with a support insert or similar if required. The free length of the support rod 4 curves upwards and outwards from the frame 2 to the mat 3.

In the preferred embodiment, the upper end 8 of the support rod 4 is fitted with an edge connector 14 to connect the upper end 8 to the edge of the mat 2 in co-operation with an edge fitting fitted to the edge of the mat 2. Other ways to connect the rods 4 to the mat 2 are also possible, such as the use of a sleeve that covers to rod and which has an upper end folded onto and sewn to the mat 2.

Accessory Attachment Rail

Four preferred forms or variants of accessory attachment system suitable for use with the trampoline 1 will now be described. For each of the first two preferred forms, as shown in FIGS. 3*a* and 3*b*, the accessory attachment system has two main parts: an accessory attachment rail 10 fitted in use to the trampoline 1, and a connector 17 that corresponds to the attachment rail 10, and which is fitted to the accessory.

For both of these first two preferred embodiments, the accessory attachment rail 10 is an extruded rail, having a continuous base 15 and two side wall portions 16 that extend upwards and angle inwards over the base, one from each side of the base 15. An open slot 11 is formed in the top of the structure formed by the two side portions 16. Although it is preferred that the slot is open, the two edges could be touching each other, and forced apart when the accessory is pulled into the slot. It can be seen that the accessory attachment rail 10 is a hollow structure with a slot 11 at the top.

Figure 3A:
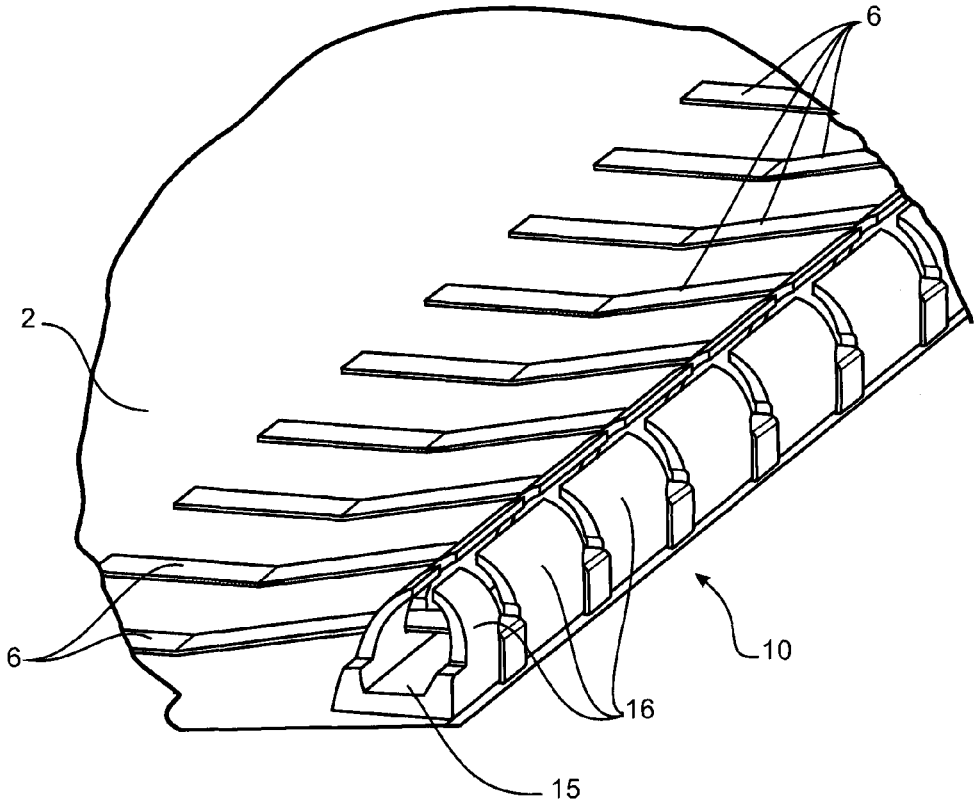
FIG. 3*a* shows a close-up view of one part of one edge of the preferred form of trampoline of FIG. 2, the edge of the trampoline fitted with an accessory attachment rail that forms a female connector, the attachment rail having a continuous base and two side wall portions that extend upwards from each side of the base to form an arch shape with an open slot at the top, the base flat against the mat, the side portions discontinuous to allow the rail to be connected to the mat by straps which loop around the rail and the edge of the mat to hold the rail in position, a portion of the body of each of the straps located in one of the gaps.
Figure 3B:
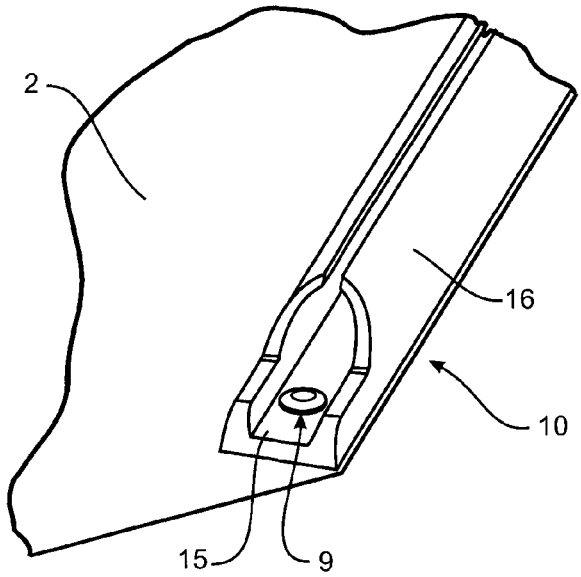
FIG. 3*b* shows an alternative attachment rail, having a continuous base and two continuous side wall portions that extend upwards from each side of the base to form an arch shape with an open slot at the top, the attachment rail connected to the mat by a fastener passed through the base and the mat to connect the mat and the rail together.

In the first two preferred forms as shown in FIGS. 3*a* and 3*b*, the side wall portions are co-extruded with the base 15, but could, if required, be manufactured separately and then connected to the base 15.

The accessory attachment rail 10 is, in the preferred use, fitted to the top of the mat 2 around substantially the entire perimeter edge of the mat 2 (except for the corners in the preferred embodiment—the rail 10 in this embodiment is actually four separate (sub-)rails, which are fitted one to each edge). However, it should be noted that the rail 10 could be fitted to the trampoline wherever it is required—e.g. close to the centre of the mat, on the frame, on the enclosure, etc. The base 15 lies flat against, and is attached to, the mat 2. In the first preferred embodiment shown in FIG. 3*a*, the side portions 16 are not continuous: there are gaps at intervals on each side. This is to allow the rail 10 to be connected to the mat 2 by straps 6 which loop around the rail 10 and the edge of the mat 2 with the ends pointing inwards. The ends of the straps 6 are connected by stitching or similar to the mat 2 to hold the rail in position. A portion of the body of each of the straps 6 is located in one of the gaps, passing across and preferably contacting the inner surface of the base 15.

In the second preferred embodiment shown in FIG. 3*b*, the side portions 16 are continuous. The rail 10 is connected to the mat 2 by a single fastener 9 or a number of fasteners 9, on the bottom or base 15 of the rail 10, the fastener 9 passing through the base 15 and the mat 2 to connect the mat 2 and the rail 10 in a manner which does not require the gaps in the side portions 16. A number of fasteners 9 can be used spaced at intervals along the rail. The fasteners 9 can be rivets or similar.

Accessories for use with the trampoline 1 are fitted with a connector 17 that corresponds to the attachment rail 10. Alternatively, the connector 17 could be integrally formed with the accessory. In the preferred embodiment, the connector 17 has a main body portion 17*a* that fits between the sides 16 of the arch as described above, and an extension portion 17*b* that extends from the main body upwards through the slot 11 to the accessory. The main body portion 17*b* fits between the sides 16, the sides 16 forming a female portion that corresponds to the male portion 17, the male and female portions interlocking in use. That is, the sides 16 curve or angle around the main body portion 17*a* of the connector to hold the accessory in position.

The extension portion 17*b* extends upwards through the slot 11 to connect with the main body of the accessory.

The preferred manner in which an accessory is fitted to the trampoline 1 is by sliding one end of the main body portion 17*a* between the sides 16 from one open end of the rail 10. However, in the most preferred embodiment, the main body portion 17*a* is formed from a non-rigid foam, and it is possible to push the main body portion 17*a* directly down through the slot, the main body 17*a* contracting and then expanding again once it is between the sides 16, the sides 16 also bending outwards and then back into position once the main body has been fully pushed down through the slot.

In the first preferred embodiment described above, with gaps in the side walls, then the connector 17 passes over the top of the strap(s) 6.

It should also be noted that the arrangement described above, with the two sides 16 aligned so that the slot is at the top, and the extension portion 17*b* extending through the slot aligned substantially vertically, can be adapted as required. The sides could be aligned so that the slot 11 is aligned to one side of the rail—i.e. one of the side walls could be larger than the other, and curve over the top of the rail to form an arch so that the slot is on one side of the mat. If the slot is to one side of the rail, it is also possible to use a single side wall that curves or angles over far enough that only one wall is necessary, the rail or base then forming the other side of the slot. That is, one wall is used which substantially surrounds a hollow centre, the one wall having a slot between the wall and the base.

Figure 4:
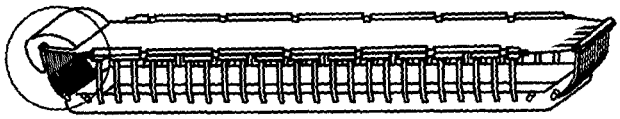
FIG. 4 shows a close-up view of one part of one edge of the preferred form of trampoline of FIG. 2, the edge of the trampoline fitted with the accessory attachment rail of FIG. 3*a* or FIG. 3*b*, a foam pad fitted to and over the edge of the trampoline to cover the edge of the mat and any hard or rigid items on or close the lower edge of the enclosure, the foam pad fitted with a corresponding male connector to allow attachment to the accessory attachment rail.
Figure 4:
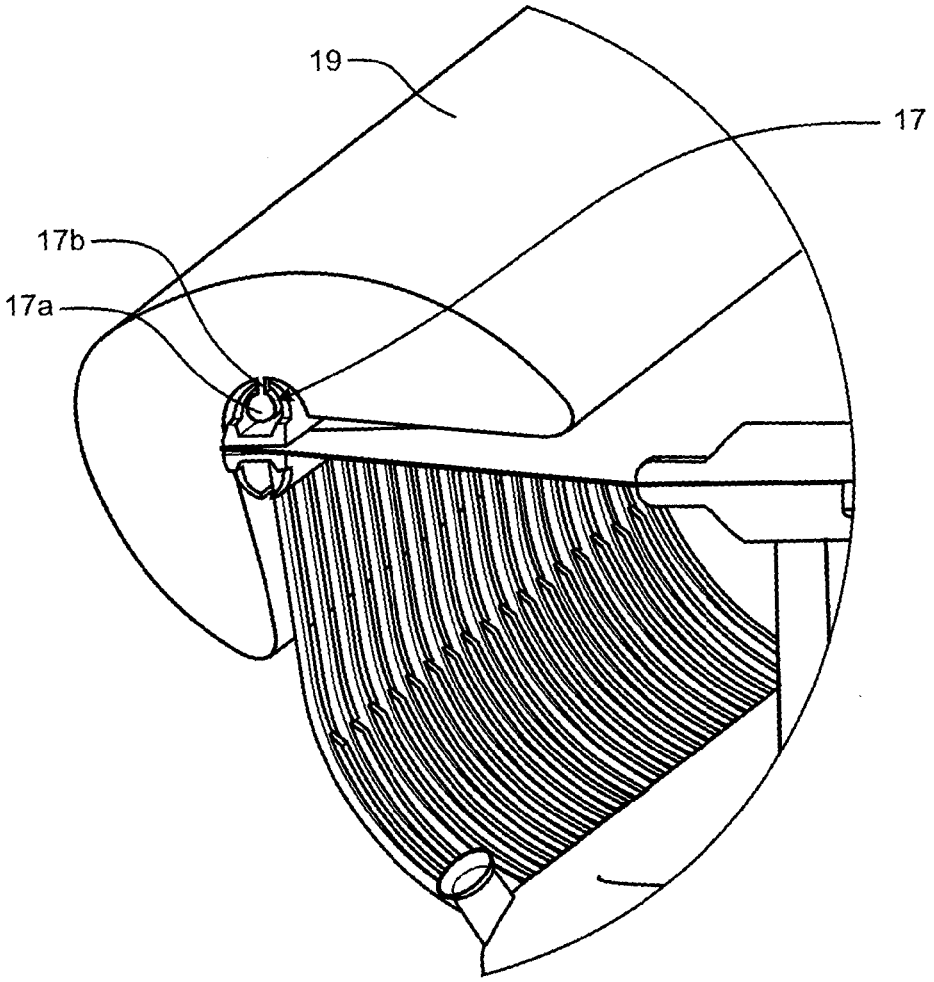

The arrangement described above can be used to attach a number of different accessories to the trampoline 1. The accessory could be an edge protector pad such as the foam pad 19 shown in FIG. 4, which is fitted to and over the edge of the trampoline 1 to cover the edge of the mat 2 and also any hard or rigid items on or close to the edge of the mat 2. The foam pad 19 provides a cushion which can help to prevent injury if a user falls at or close to the edge of the mat 2. Another benefit is that by completely attaching the pad, a uniform surface is presented, with no "gaps" for legs or arms to slide under and catch on things like the hook end of a spring. As shown in FIG. 4, a lower surface of the foam pad 19 is fitted with the connector 17, which fits into the slot on rail 10 to connect the foam pad 19 to the trampoline.

Figure 5:
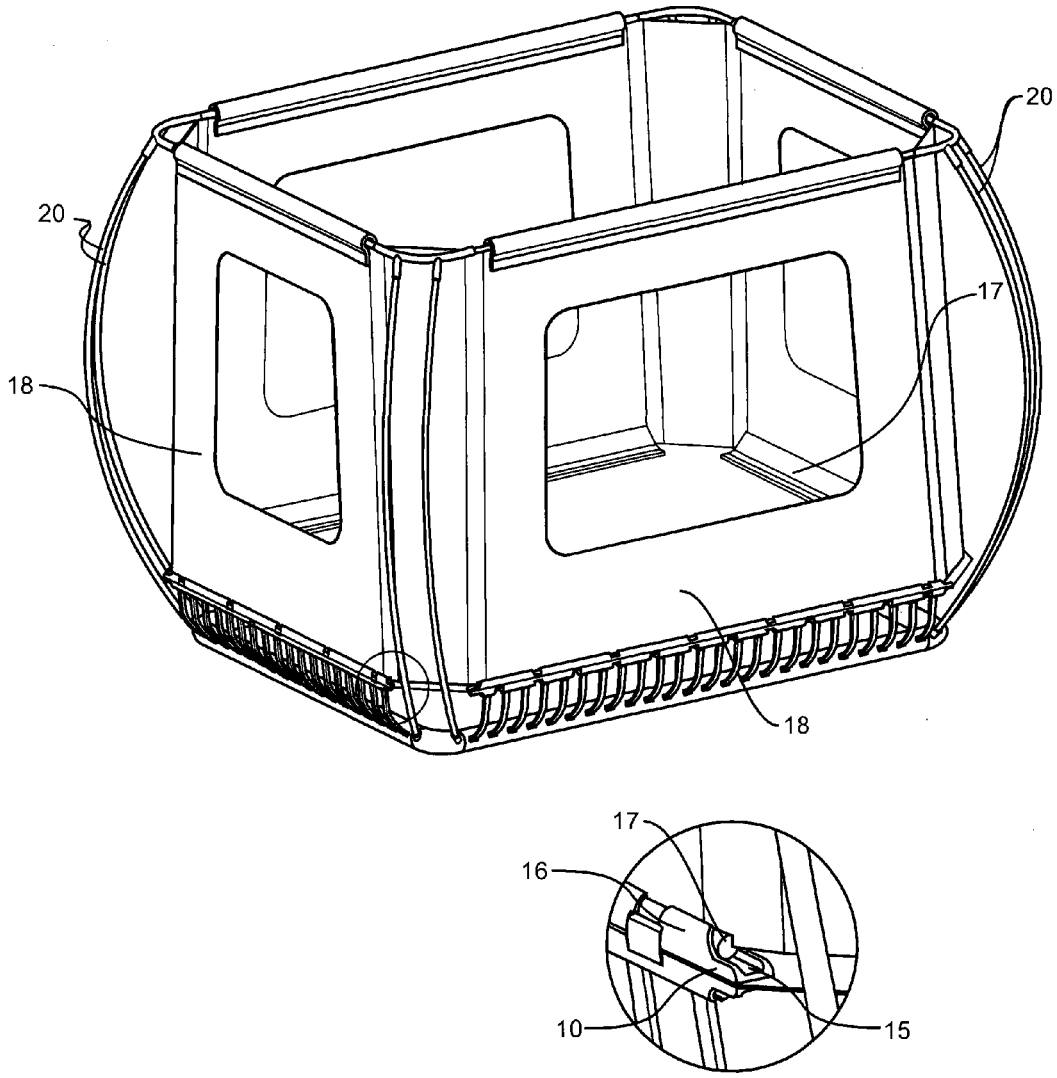
FIG. 5 shows the trampoline of FIG. 2 fitted with an enclosure, the enclosure supported by wall members, the edge of the trampoline fitted with the accessory attachment rail of FIG. 3*a* or 3*b*, the lower edge of the enclosure fitted with a corresponding male connector.
Figure 7:
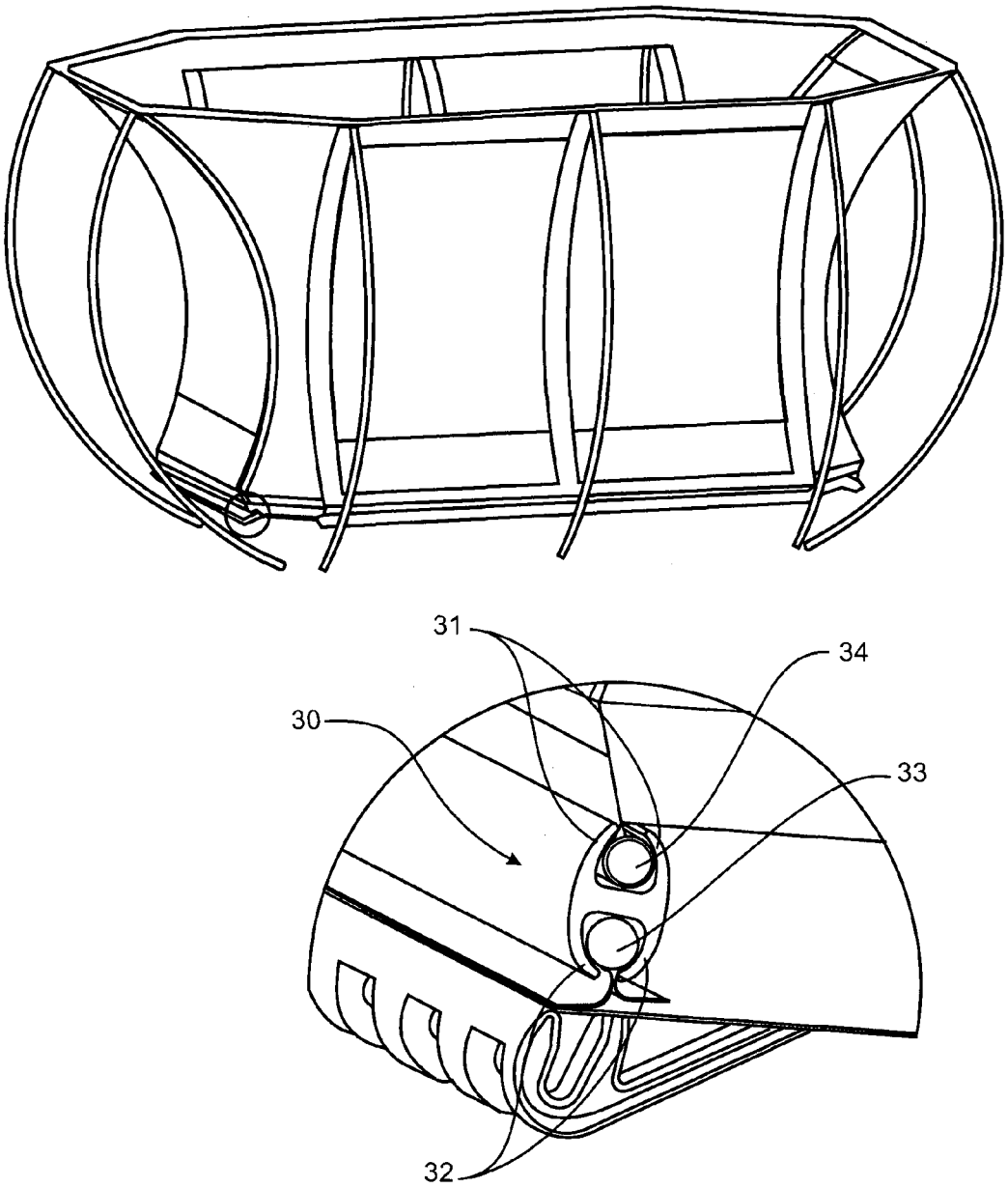
FIG. 7 shows the trampoline of FIG. 2 fitted with an enclosure, the lower edge of the enclosure fitted with a fourth form of attachment rail having a double pair of side walls, each pair extending from a central base portion, one pair facing upwards in use, and the second pair facing downwards, the accessory attachment rail having the overall appearance of a capital 'H', with the ends of each one of the four uprights curved or angled inwards towards the other one of the pair, and the central base portion forming the 'horizontal' or cross-piece of the 'H', a mat connector attached to the trampoline facing upwards, and a second accessory or enclosure connector connected to the lower edge of the enclosure or accessory, facing downwards, each of the connectors circular in cross-section, and pushed between the pairs of side walls on the upper and lower side respectively to hold the connectors in position and to attach the accessory attachment rail to the mat, and the enclosure or accessory to the attachment rail.

Alternatively, the accessory could for example be an item such as the wall of a safety enclosure or similar. The enclosure wall 18 shown in FIG. 5 could be fitted with a connector 17 on or close to its lower edge, so that it can be fitted to the trampoline 1. The connector 17 is attached to or forms part of the lower edge of the wall of the enclosure, and as shown in FIG. 7 slots into the rail 10 so that the base or lower edge of the side wall is connected to the edge of the trampoline mat. The wall or walls of the enclosure are supported by wall members 20 connected between an upper part or portion of the wall of the enclosure and the remainder of the trampoline system.

Other auxiliary accessories can be fitted with the connector 17 for use as required. For example, a protective or weather cover could be fitted with the connector 17 so that the trampoline 1 can be easily covered when not in use. A ladder, slide or similar can be fitted with the connector 17 to allow it to be easily fitted to the trampoline 1.

A "fast fit" soccer goal net could also be used as one of a possible range of accessories. The trampoline could be tilted to e.g. a 70 degree off horizontal by using a support or similar, and a soccer goal net attached around the perimeter of the rebounding mat using the connector arrangement described above. Children could then kick the ball at the elevated rebounding surface and have the ball either rebound back to them off the surface (a good shot) or caught in the net (which would extend outside of the mat surface area to "catch" wayward shots). This arrangement could be used for other ball sports/games such as tennis or softball practice.

The arrangement described above allows accessories to be conveniently and rapidly added or removed from the trampoline 1. There is no requirement for the trampoline to be partly or wholly disassembled, for example by removing the upper ends 8 of the support rods 4 from the edge connector 14 on the edge of the mat 2.

The arrangement above also has the advantage that the connector 17 (and the associated accessory) can be retained securely in relation to the rail 10. The dimensions and structural materials of the rail and the connector can be chosen so that even under the conditions of most vigorous use, the connector remains in position relative to the rail—for example, the stiffness of the sides of the rail can be controlled by adjusting the dimensions (e.g. wall thickness) and the material used to make the rail, so that the wall will not bend or flex and allow the connector to release during vigorous use.

The accessory attachment system described above has been described in relation to a form of trampoline 1 as shown in FIG. 2 which is the preferred form of trampoline which the accessory attachment system is used with. However, it should be noted that the accessory attachment system described could be fitted to any existing trampoline or style of trampoline such as is known in the art. For example, the trampolines shown in FIGS. 1*a* and 1*b* could be fitted with the accessory attachment system described above. The rail 10 could also be formed curved to follow the curve of the edge of, for example, a circular or oval trampoline mat, or any trampoline mat having one or more curved edges or sides.

Figure 1A:
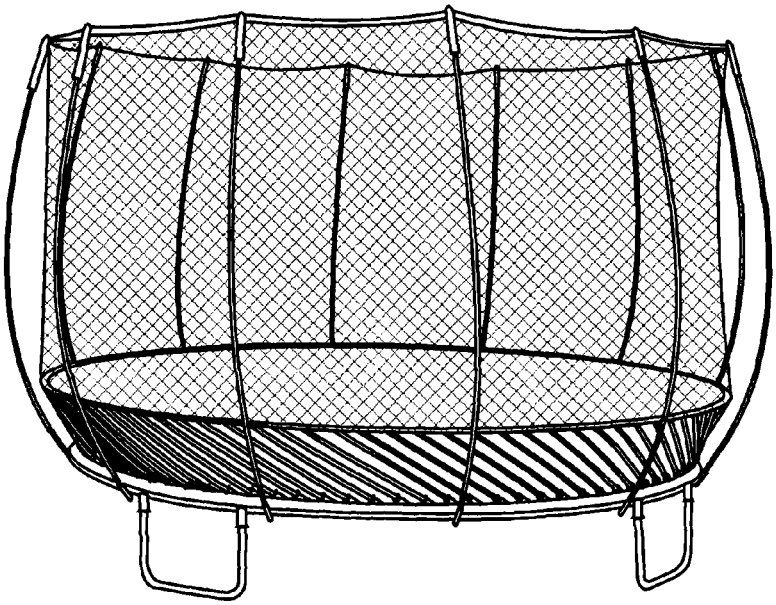
FIG. 1*a* shows a first form of prior art trampoline system, the trampoline system having a frame, a jumping mat and an enclosure net held above, and surrounding, the jumping mat to form an enclosed jumping area, the frame and jumping mat connected via a number of fiberglass rods extending upwards from the frame to the edge of the mat, the lower edge of the enclosure net connected to the edge of the jumping mat.

The mat of the trampoline shown in FIG. 1*a* is supported by a plurality of resiliently flexible rods received in a frame of the trampoline at the lower ends of the rods, the upper end of the rods coupled to the periphery of the bouncing or rebounding mat of the trampoline, the rods angled or spiralled around the frame, extending outwards and upwards from the frame.

Figure 1B:
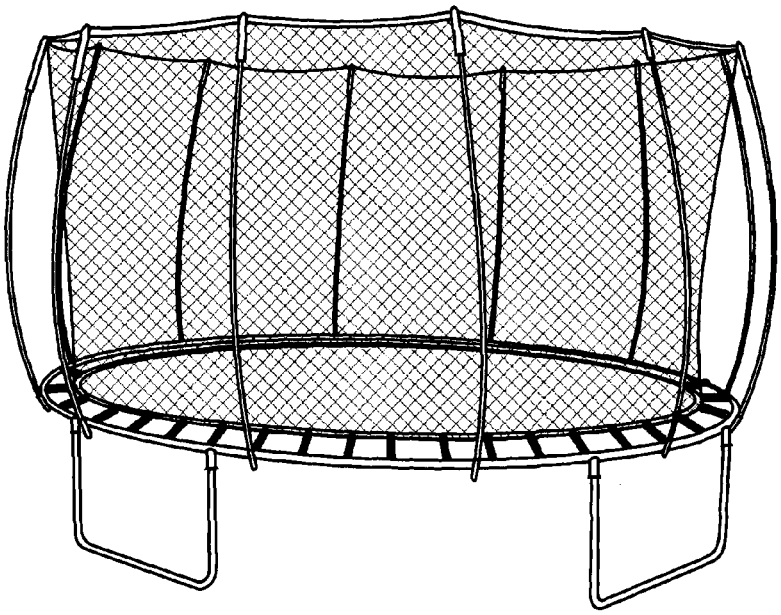
FIG. 1*b* shows a second form of prior art trampoline system, the trampoline system also having a frame, a jumping mat and an enclosure net held above, and surrounding, the jumping mat to form an enclosed jumping area, the frame and jumping mat connected via a number of springs aligned generally horizontally and extending outwards from the mat to the frame, the lower edge of the enclosure net connected to the edge of the jumping mat.

The trampoline shown in FIG. 1*b* uses a number of springs, which extend inwards from the frame to the edge of the mat, the springs generally in the same plane as the frame and the rebounding surface of the mat.

The trampoline of the preferred embodiment in FIG. 2 uses a number of rods that extend outwards and upwards from the frame to the mat, aligned generally perpendicular to the mat.

The spiralled rods, springs and perpendicularly aligned rods of the trampolines of FIGS. 1*a*, 1*b*, and 2 can generally be categorised as 'spring members'.

The side wall or walls 16 as described above are described as 'curved' or angled' as they extend away from the base. For example, if two side walls are used which curve towards one another, the shape formed will be an arch with a slot 11, formed around a hollow centre area of the rail, between the walls and the base. The preferred embodiment is open-topped, but the top edges could be in contact. Where the word 'angled' is used, this should be taken to mean a side wall which can be curved to form an arch shape, but is not necessarily curved. 'Angled' should be taken to mean a wall or walls which have at least one straight side which is arranged at an angle to the base or to a portion of itself, or both—e.g. one part of the side or surface of the wall is angled in relation to another portion of the side or surface of the same wall. For example, the two side walls could angle towards one another so that from one end the accessory attachment rail 10 has a triangular profile with a slot between the two side walls. One or both of the side walls could also be bent between their upper and lower edges, so that (if both walls are for example bent towards one another) the end outline is that of a pentagon with a slot. If one wall is used, this could have two or more sides, so that the end outline is a triangle, square, pentagon or similar. The one wall could also be fully curved, so that the end outline is oval or circular, with a slightly flattened side where the base is. It should also be noted that if two side walls are used, these do not necessarily have to have the same dimensions. For example, if two straight side walls are used, angled towards one another so that the profile is triangular, one could be shorter or smaller than the other, so that the slot between them is offset to one side of the centreline.

In the context of this specification, 'slot' should be taken to mean break or discontinuity that passes from inside the hollow area defined by the base and the wall or walls, to the outside of the rail. As outlined above, the two edges of the slot could be open, or they could touch each other (initially closed) with the two sides forced apart when the accessory is pulled into the slot, and the definition of 'slot' should be taken to be broad enough to cover both of these options. The slot could also run the full length of the rail, or only part of the length. Multiple slots could be used on a single rail also, spaced along the length of the rail.

As described above, the first two preferred embodiments of the rail have both ends open. One or both of these could be closed rather than open. Also, the hollow area does not have to run the full length of the rail. If required for structural reinforcement or similar, the rail could be wholly or partly 'filled' or solid along at least part of the length of the rail.

Two further forms or variants of accessory attachment system suitable for use with the trampoline 1 will now be described with reference to FIGS. 6 and 7.

Figure 6:
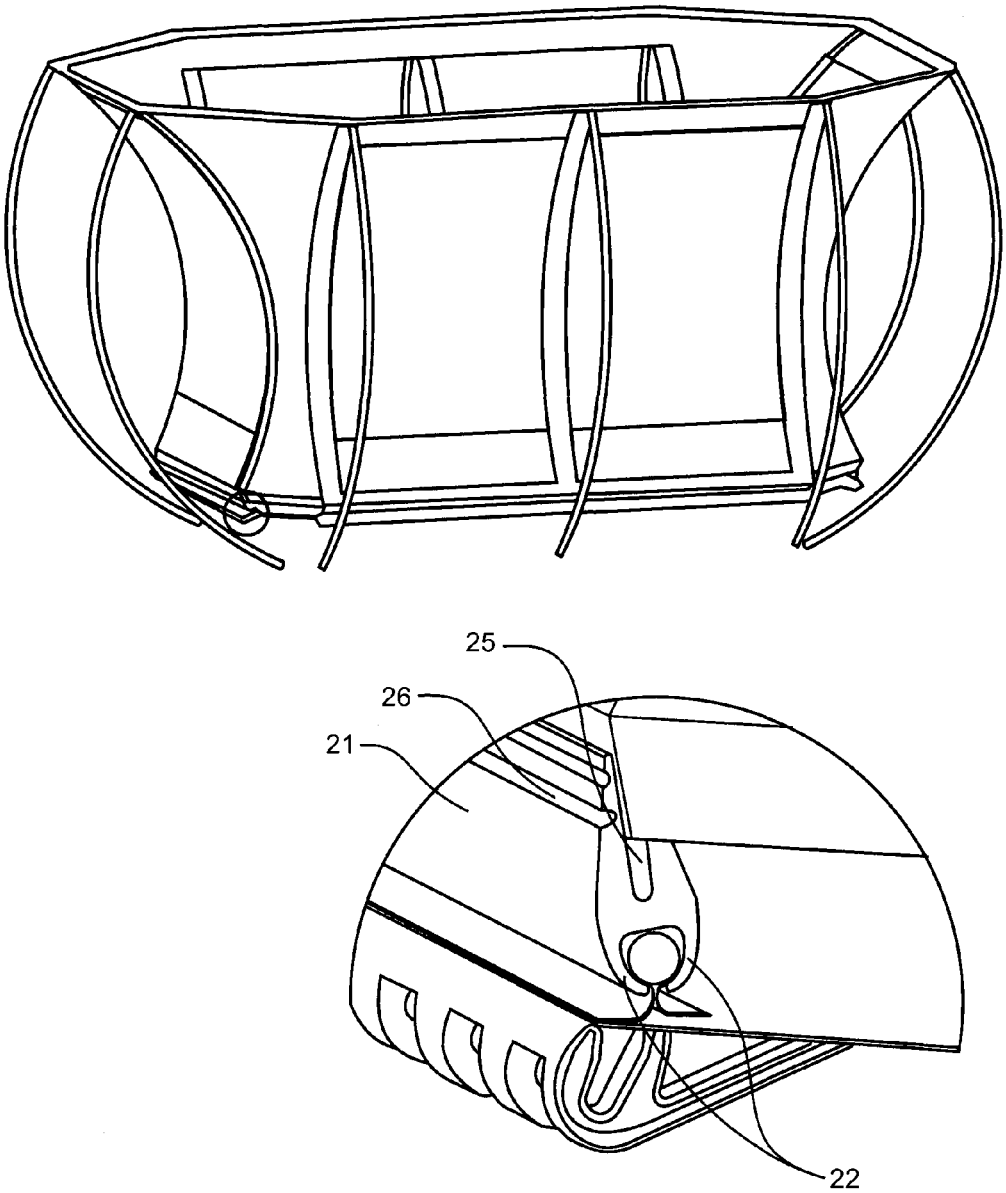
FIG. 6 shows the trampoline of FIG. 2 fitted with an enclosure, the lower edge of the enclosure fitted with a third form of attachment rail having a base with a narrow upwards-opening groove into which the edge of the enclosure locates, and two side wall portions that extend downwards from each side of the base to form an arch shape with an open slot at the bottom, the enclosure and third form of attachment rail connected to the trampoline by way of a connector fitted to the trampoline which is circular in cross-section and which locates between the two side walls of the attachment rail in use.

The accessory attachment rail 21 shown in FIG. 6 is similar to the rails shown in FIGS. 3*a* and 3*b*. However, in the preferred use configuration, the side wall portions 22 extend downwards, and the base portion 23 upwards. In use, the base portion 23 is connected to the enclosure or other accessory, and a corresponding mat connector 24 is attached to the trampoline mat (although as outlined for the connector 17 of the first two embodiments above, it may also be connected to the frame, or close to the centre of the mat, or in any other suitable and desirable location. The main body of the connector 24 is the same as in the preferred form, and the same as for the connector 17 of the first two preferred embodiments described above: circular in cross-section. The main body of the connector 24 is in use located between the side wall portions 22, which curve or angle towards one another over the body of the connector 24 to hold it in position. A portion of the connector 24 extends away from the main body, through the slot, to e.g. the mat to attach to the mat. The connector 24 is formed by folding a piece of webbing in half and sewing along its length to create a pocket which is filled with a plastic tube, a length of rope/cord, or a fibreglass rod. This piece of webbing is then sewn to the mat surface.

The bottom edge of the enclosure can be formed in a similar way: a section of the enclosure fabric can be folded over and sewn to form a cavity that in use holds a tube. Alternatively, the edge of the fabric can be rolled into a tube. The edge is then sewn through to form a more solid edge. Another alternative would be to knit the tubular form as part of the edge.

The walls of the accessory attachment rail 21 are, in the embodiment shown, continuous. However, they could be discontinuous, in a similar fashion to the rail embodiment shown in FIG. 3*a*.

The upwards-facing base portion 23 includes a slot or groove 25 running substantially the full length of the attachment rail 21, aligned running parallel to the groove formed by the two side wall portions 22, with an upward-facing opening. In use, a lower edge of the enclosure or other accessory is located into the upper groove 25. In the most preferred embodiment, each of the side walls of the base portion each side of the slot include at least one cut-out trench each side, aligned running substantially horizontally, substantially the length of the side wall, so that the trench 26 on the outer side faces outwards and the trench on the inner side (not shown) faces inwards. The trenches are located substantially at the same position or height on the inner and outer side walls. The trenches are formed so that the thickness of the wall between the trenches and the groove 25 is thin enough to be sewn through by a sewing machine needle or similar. In this fashion, the lower edge of the enclosure or accessory can be attached by sewing to the attachment rail 21.

It should be noted that although sewing is the most preferred way of attaching the enclosure or accessory to the rail 21, other ways are also envisaged, such as gluing, plastic welding, riveting, etc. It should also be noted that the rail could be arranged to face the other way up, with the base downwards and sewn to e.g. the mat, frame, etc.

The fourth form of accessory attachment rail 30 shown in FIG. 7 has a double pair of side walls, one pair 31 facing upwards in use, and the second pair 32 facing downwards, from a central base portion. In cross-sectional profile, the accessory attachment rail 30 has the overall appearance of a capital 'H', with the ends of each one of the four uprights curved or angled inwards towards the other one of the pair, and the central base portion forming the 'horizontal' or cross-piece of the 'H'. The walls are continuous in the preferred form, by may be discontinuous if required, on one or both sides.

In use, a mat connector 33 is attached to e.g. the mat of the trampoline, facing upwards, and a second accessory or enclosure connector 34 is connected to the lower edge of the enclosure or accessory, facing downwards. Each of the connectors 33 and 34 in the preferred embodiments are circular in cross-section. The connectors are pushed between the pairs of side walls on the upper and lower side respectively, and the side walls arc or curve around the circular bodies to hold the connectors in position. In this fashion, the accessory attachment rail 30 is attached to the mat, and the enclosure or accessory is attached to the attachment rail 30, thus holding the enclosure or accessory in position relative to the mat.

As outlined above, the attachment rail 30 could be connected to an item other than the mat if required, such as the frame or similar. The connectors 33 and 34 can be formed in the same or similar manner to that outlined above.

The foregoing description of the invention includes preferred forms thereof.

Modifications may be made thereto without departing from the scope of the invention.

The invention claimed is:

1. A trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, an accessory attachment rail extending around the perimeter of the trampoline and having a base connected to the trampoline, and at least one side wall portion, the at least one side wall or walls extending from and angled to the base to define and surround a hollow central area between the wall and the base, and to further define a slot that passes from inside the hollow central area to outside the rail, into which hollow central area a connector of an accessory to be fitted to the trampoline can be engaged, the connector comprising a main body portion and an extension portion that extends from the main body portion, and said connector is fitted to the trampoline in use by sliding the main body portion of the connector within the hollow central area, with extension portion extending through the slot in the accessory attachment rail.

2. A trampoline system as claimed in claim 1 wherein the accessory attachment rail is connected to the rebounding mat, at or close to the edge of the rebounding mat.

3. A trampoline system as claimed in claim 2 wherein the accessory attachment rail extends substantially around the entire perimeter of the rebounding mat.

4. A trampoline system as claimed in claim 1 wherein two side wall portions extend from the base to form an arch shape having a slot.

5. A trampoline system as claimed in claim 4 wherein the trampoline system further has at least one fastener which passes through the base of the accessory attachment rail to connect the accessory attachment rail to the mat.

6. A trampoline system as claimed in claim 1 together with an accessory having a connector comprising of a main body portion and an extension portion that extends from the main body portion, the main body portion is sized and shaped to fit within the hollow central area and the extension portion to extend through the slot, of the accessory attachment rail.

7. A trampoline system as claimed in claim 6 wherein the accessory is fitted to the trampoline of the trampoline system by sliding the main body portion into the hollow central area from one open end of the rail.

8. A trampoline system as claimed in claim 6 wherein the accessory is a foam pad, arranged to fit to and over the edge of the trampoline mat to cover the edge of the mat.

9. A trampoline system as claimed in claim 6 wherein the accessory is a safety enclosure, the wall of the enclosure fitted with a connector on or close to the lower edge of the wall.

10. A trampoline system as claimed in claim 1 wherein the slot is open.

11. A trampoline system as claimed in claim 10 wherein two side wall portions extend from the base to form an arch shape having a slot.

12. A trampoline system as claimed in claim 1 wherein the trampoline system further has at least one fastener, and the base has at least one corresponding aperture, a portion of the fastener passing through the corresponding aperture to connect the accessory attachment rail to the mat.

13. A trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, an accessory attachment rail extending around a perimeter of the trampoline and having a base connected to the trampoline, and a safety enclosure for the trampoline system, comprising:

a wall or walls corresponding to each side of a mat and extending upwards from edges of the mat substantially vertically, the wall or walls each having a connector attached to or forming part of a lower edge of the wall, the connector having a main body portion located in a hollow central area of the accessory attachment rail and an extension portion extending from the main body portion through a slot in the accessory attachment rail connecting the lower edge of the wall or walls to the trampoline, the wall or walls supported by wall members connected between an upper part or portion of the wall or walls and the remainder of the trampoline system.

14. A trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, an accessory attachment rail extending around a perimeter of the trampoline and having a base connected to the trampoline, and an edge protector for the trampoline system, comprising:

an edge protector pad shaped and sized to fit to and over an edge of the trampoline to cover an edge of the mat, a lower surface of the pad having a connector attached to or forming part of the lower surface of the pad, the connector having a main body portion located in a hollow central area of the accessory attachment rail and an extension portion extending from the main body portion through a slot in the accessory attachment rail connecting the edge protector to the trampoline.

15. A trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, an accessory attachment rail extending around the perimeter of the trampoline and having a base portion, and a pair of side walls which extend from and which are angled to the base to define and surround a hollow central area between the wall and the base, and to further define a slot that passes from inside the hollow central area to outside the rail, into which hollow central area a connector of an accessory to be fitted to the trampoline can be engaged, the connector comprising a main body portion and an extension portion that extends from the main body portion, and said connector is fitted to the trampoline in use by sliding the main body portion of the connector within the hollow central area, with extension portion extending through the slot in the accessory attachment rail, and the base portion having a groove which runs substantially the full length of the attachment rail and parallel to the hollow central area, the groove having an outwards-facing opening.

16. A trampoline system as claimed in claim 15 wherein the groove forms a pair of side walls in the base portion, each of the side walls having at least one trench formed therein and aligned running substantially the length of each side wall.

17. A trampoline system as claimed in claim 16 wherein each trench is located at substantially the same position or height on each of the side walls.

18. A trampoline system as claimed in claim 16 wherein each trench is formed so that a portion of the side wall between the trench and the groove can be sewn through.

19. A trampoline system as claimed in claim 15 wherein the trampoline system also has a mat connector, having a main body portion sized and shaped to fit within the hollow central area, and an extension portion extending through the slot to attach to the trampoline.

20. A trampoline system as claimed in claim 19 wherein the mat connector is connected to the trampoline mat.

21. A trampoline system as claimed in claim 19 wherein the mat connector is connected to the frame.

22. A trampoline system comprising:

a trampoline, having a flexible rebounding mat, a frame, and a plurality of spring members connecting between the frame and the mat, the frame and the spring members holding the mat in tension and aligned in a substantially horizontal plane spaced above the ground, a removable accessory attachment rail extending around the perimeter of the trampoline and having;

a base, a first pair of side walls extending from the base in a first direction and angled to the base and to one another to define and surround a first hollow central area between the first walls and the base, and to further define a first slot that passes from inside the hollow central area to outside the rail, a second pair of side walls extending from the base in a second direction and angled to the base and to one another to define and surround a second hollow central area between the second walls and the base, and to further define a second slot that passes from inside the hollow central area to outside the rail, and wherein a connector of an accessory to be fitted to the trampoline can be engaged within one of the first hollow central area or the second hollow central area, the connector comprising a main body portion and an extension portion that extends from the main body portion, and said connector is fitted to the trampoline in use by sliding the main body portion of the connector within the first hollow central area or the second hollow central, with the extension portion extending through the corresponding first slot or second slot in the accessory attachment rail.

23. A trampoline system as claimed in claim 22 wherein the first pair of side walls and the second pair of side walls extend in substantially opposed directions from the base so that the accessory attachment rail has the overall appearance of a capital 'H', with the ends of each one of the four uprights curved or angled inwards towards the other one of the pair.

* * * * *